US007909985B2

(12) United States Patent
Hong et al.

(10) Patent No.: US 7,909,985 B2
(45) Date of Patent: Mar. 22, 2011

(54) FRAGMENTATION OF HEAVY HYDROCARBONS USING AN OZONE-CONTAINING FRAGMENTATION FLUID

(75) Inventors: Andy Hong, Salt Lake City, UT (US); Willem P C Duyvesteyn, Reno, NV (US)

(73) Assignee: University of Utah Research Foundation, Salt Lake City, UT (US)

( * ) Notice: Subject to any disclaimer, the term of this patent is extended or adjusted under 35 U.S.C. 154(b) by 968 days.

(21) Appl. No.: 11/318,056

(22) Filed: Dec. 23, 2005

(65) Prior Publication Data

US 2006/0163117 A1 Jul. 27, 2006

Related U.S. Application Data

(60) Provisional application No. 60/638,882, filed on Dec. 23, 2004.

(51) Int. Cl.
*C10G 9/00* (2006.01)

(52) U.S. Cl. ..... 208/7; 208/44; 208/952

(58) Field of Classification Search ..... 208/290, 208/952, 125, 7, 44
See application file for complete search history.

(56) References Cited

U.S. PATENT DOCUMENTS

| | | | | |
|---|---|---|---|---|
| 3,484,365 | A * | 12/1969 | Pitchford | 208/44 |
| 3,706,341 | A | 12/1972 | Redford | |
| 3,825,066 | A | 7/1974 | Redford | |
| 4,341,619 | A | 7/1982 | Poska | |
| 4,397,736 | A | 8/1983 | Low | |
| 4,447,310 | A * | 5/1984 | Derbyshire et al. | 208/415 |
| 4,455,216 | A | 6/1984 | Angevine et al. | |
| 4,483,761 | A * | 11/1984 | Paspek, Jr. | 208/106 |
| RE32,120 | E | 4/1986 | Low | |
| 4,592,826 | A | 6/1986 | Ganguli | |
| 4,719,000 | A * | 1/1988 | Beckberger | 208/44 |
| 4,772,379 | A | 9/1988 | Gomberg | |
| 4,818,373 | A | 4/1989 | Bartholic et al. | |
| 4,883,581 | A | 11/1989 | Dickakian | |
| 4,992,160 | A | 2/1991 | Long et al. | |
| 5,232,604 | A | 8/1993 | Swallow et al. | |
| 5,296,130 | A | 3/1994 | Kriz et al. | |
| 5,326,456 | A | 7/1994 | Brons et al. | |
| 5,344,553 | A | 9/1994 | Shih | |
| 5,496,464 | A | 3/1996 | Piskorz et al. | |
| 5,591,893 | A * | 1/1997 | Kulpe et al. | 562/504 |
| 5,785,860 | A | 7/1998 | Smith | |
| 5,849,201 | A | 12/1998 | Bradley | |
| 6,060,291 | A | 5/2000 | Park et al. | |
| 6,242,165 | B1 | 6/2001 | Vaartstra | |
| 6,387,278 | B1 | 5/2002 | Leif et al. | |
| 6,458,407 | B1 | 10/2002 | Miki et al. | |
| 6,524,469 | B1 | 2/2003 | Schucker | |
| 6,576,145 | B2 | 6/2003 | Conaway et al. | |
| 6,740,785 | B2 | 5/2004 | Subramaniam et al. | |
| 6,745,832 | B2 | 6/2004 | Wellington et al. | |
| 7,011,749 | B2 | 3/2006 | Hayes et al. | |
| 7,115,203 | B2 | 10/2006 | Hayes et al. | |
| 2002/0030022 | A1 * | 3/2002 | Bradley | 210/752 |
| 2002/0038778 | A1 | 4/2002 | Maa et al. | |
| 2004/0011746 | A1 | 1/2004 | Joussot-Dubien et al. | |

FOREIGN PATENT DOCUMENTS

| | | |
|---|---|---|
| DE | 10236791 | 2/2004 |
| WO | WO 98/54098 | 12/1998 |
| WO | WO 01/32936 | 5/2001 |
| WO | WO01/32936 | 5/2001 |

OTHER PUBLICATIONS

Lang et al. "Utilization of Tar from Low-Temperature Carbonization of Coal", Presentation for the Division of Gas and Fuel Chemistry, American Chemical Society Meeting, Apr. 5-10, 1959. Retrieved from <http://www.anl.gov/PCS/acsfuel/preprint%20archive/Files/03_1_BOSTON_04-59_0045.pdf> Jan. 28, 2010.*

Benito, A.M.; Martinez, M.T.; Fernandez, I.; Miranda, J.L., 1996 Upgrading of an Asphaltenic Coal Residue: Thermal Hydroprocessing. Energy & Fuels, 10(2), 401-8.

Clark, Peter D.; Kirk, Martin J., Studies on the Upgrading of Bituminous Oils with Water and Transition Metal Catalysts. Energy & Fuels, 1994, 8(2), 380-7.

Dehkissia, Soumaine; Larachi, Faical; Chornet, Esteben, 2004, Catalytic (Mo) upgrading of Athabasca bitumen vacuum bottoms via two-step hydrocracking and enhancement of Mo-heavy oil interaction. Fuel, 83(10), 1323-1331.

Demirbas, Ayhan, Recovery of asphaltenes from tar sand by supercritical fluid extraction. Petroleum Science and Technology, 2000, 18 (7 & 8), 771-781.

Garcia-Arellano Humberto; Buenrostro-Gonzalez Eduardo; Vazquez-Duhalt Rafael, Biocatalytic transformation of petroporphyrins by chemical modified cytochrome C. Biotechnology and bioengineering, 2004, 85(7), 790-8.

(Continued)

*Primary Examiner* — Walter D Griffin
*Assistant Examiner* — Renee Robinson
(74) *Attorney, Agent, or Firm* — Thorpe North & Western LLP

(57) ABSTRACT

A method for recovering valuable chemical products from heavy hydrocarbons such as tar sand or petroleum waste products is disclosed and described. Heavy hydrocarbons can be contacted with a fragmentation fluid which includes ozone and a solvent carrier. The fragmentation fluid can be provided at supercritical conditions. For example, supercritical $CO_2$ can be an effective liquid solvent carrier for ozone. During contact with the fragmentation fluid, the heavy hydrocarbons are reduced in size to form a product mixture of chemical compounds. This product mixture typically includes chemical species which are more suitable than the original heavy hydrocarbons to commercial uses and/or further separation to provide useful starting materials for a wide variety of synthesis and industrial applications.

16 Claims, 1 Drawing Sheet

OTHER PUBLICATIONS

Jamaluddin, A.K.M.; Nazarko, T.W.; Sills, Suzanne; Fuhr, B.J., Deasphalted oil—natural asphaltene solvent. Proceedings—International Symposium on Oilfield Chemistry, San Antonio, Feb. 1995, 14-17, 513-522. Society of Petroleum Engineers, Richardson, TX.D.
Kamimura, H.; Takahashi, S.; Kishita, A.; Moriya, T.; Hong, Enomoto, Upgrading of bitumen with supercritical water for a system combined with SAGD. Symposia—American Chemical Society, Division of Fuel Chemistry, 1998, 43(3), 741-745.
Kishita, Astushi; Takahashit, Satoru; Kamimura, Hirotaka; Miki, Masami; Moriya, Takehiko, Enomoto, Heiji, Upgrading of bitumen by hydrothermal visbreaking in supercritical water with alkali. Journal of the Japan Petroleum Institute, 2003, 46(4), 215-221.
Moschopedis, Speros E.; Speight, James G., Oxidation of a bitumen in relation to its recovery from tar sand formations. American Chemical Society, Division of Fuel Chemistry, 1974, 19(2), 192-201.
Nelson, William, M.; Puri, Ishwar K., Oxidation of CH3CH0 by 03 and H202 Mixtures in Supercritical CO2 in a Perfectly Stirred Reactor. Industrial & Engineering Chemistry Research, 1997, 36(9), 3446-3452.
Oblad, A.G.; Bunger, J.W.; Hanson, F.V.; Miller, J.D.; Seader, J.D., The extraction of bitumen from western tar sands: final report., 1989, Report E/MC/25046-2875; Order No. DE90015334, 179 pp. From: Energy Res. Abstr. 1991, 16(1), Abstr. No. 149.
Ovalles, Cesar; Rengel-Unda, Pablo; Bruzual, Jenny; Salazar, Arelys, Upgrading of extra-heavy crude using hydrogen donor under steam injection conditions. Characterization by pyrolysis GC-MS of the asphaltenes and effects of a radical initiator. American Chemical Society, Division of Fuel Chemistry, 2003, 48(1), 59-60.
Rahimi, Parviz M.; Parker, Richard, J.; Gentzis, Thomas; Tsaprailis, Harry, Processability of partially deasphalted athabasca bitumen. Abstracts, 221st ACS National Meeting, San Diego, CA, United States, Apr. 1-5, 2001, PETR-005.
Rose, J.L.; Monnery, W.D.; Chong, K.; Svrcek, W.Y., Experimental data for the extraction of Peace River bitumen using supercritical ethane. Fuel, 2001, 80(8), 1101-1110.
Sadeghi, Kazem M.; Lin, Jiunn-Ren; Yen, The Fu., Sonochemical treatment of fossil fuels. Energy Sources, 1994, 16(3), 439-49.
Sadeghi, Kazem M.; Lin, Jiunn-Ren; Yen, The Fu., Sonochemical treatment of fuel components. American Chemical Society, Division of Fuel Chemistry, 1992, 37(1), 86-91.
Sato, Takafumi; Adschiri, Tadafumi; Arai, Kunio; Rempel, Garry L.; Ng, Flora T.T., Upgrading of asphalt with and without partial oxidation in supercritical water. Fuel, 2003, 82(10), 1231-1239.
Scott, C.E.; Delgado, O.; Bolivar, C.; Ovalles, C., Upgrading of Hamaca crude oil using formic acid as hydrogen precursor under steam injection conditions. American Chemical Society, Division of Fuel Chemistry, 2003, 48(1), 52-53.
Scott, D.S.; Radlein, D.; Piskorz, J.; Majerski, P.; Debruijn, T.J.W., Upgrading of bitumen in supercritical fluids, Fuel, 2001, 80(8), 1087-1099.
Strausz, Otto P.; Mojelsky, Thomas W.; Payzant, John D.; Olah, George A.; Prakash, G. K. Surya, Upgrading of Alberta heavy oils by superacid-catalyzed hydrocracking. Energy & Fuels, 1999, 13(3), 558-569.
Subramanian, M.; Hanson, F.V., Supercritical fluid extraction of bitumens from Utah oil sands. Fuel Processing Technology, 1998, 55(1), 35-53.
Wang, Jiqian; Deng, Wenan; Que, Guohe, Upgrading of residue oil slurry bed hydrocracking bottom oil by solvent processing. Preprints—American Chemical Society, Division of Petroleum Chemistry, 2003, 48(4), 344-347.
Wang, Jinsheng; Anthony, Edward J., A study of thermal-cracking behavior of asphaltenes. Chemical Engineering Science, 2003, 58 (1), 157-162.
Xia, T.X.; Greaves, M., Upgrading Athabasca tar sand using Toe-to-Heel Air Injection. Journal of Canadian Petroleum Technology, 2003, 41(8), 51-57.
Cesar Ovalles, et al., Downhole Upgrading of Extra-heavy Crude Oil Using Hydrogen Donors and Methane Under Steam Injection Conditions, Petroleum Science and Technology, 2003, vol. 21, Nos. 1 & 2, pp. 255-274.

* cited by examiner

FRAGMENTATION OF HEAVY HYDROCARBONS USING AN OZONE-CONTAINING FRAGMENTATION FLUID

RELATED APPLICATION

The present application claims benefit of earlier U.S. Provisional Patent Application No. 60/638,882 filed on Dec. 23, 2004, which is hereby incorporated by reference in its entirety.

FIELD OF THE INVENTION

The present invention relates to methods and systems for upgrading heavy hydrocarbons. More particularly, the present invention relates to using supercritical fluids and ozone to upgrade heavy hydrocarbons such as asphaltenes and other poor quality materials through the use of environmentally safe materials. Accordingly, the present invention involves the fields of chemistry, process engineering, and petroleum engineering.

BACKGROUND OF THE INVENTION

The continental United States has an estimated 144 billion barrels of oil resources, of which 68 billion barrels are in the form of heavy oil (63 billion barrels in California), and the rest 76 billion barrels are in the form of natural bitumen contained in tar sand in various states. Utah has the largest tar sand reservoir accounting for almost half of the total in the U.S. Tar sand resources in the U.S. remain virtually undeveloped for a lack of technically and economically viable technologies. Additionally, Canada has the world's largest oil sand reservoir estimated at 4.5 trillion barrels, and nearly half of the oil now used in Canada comes from upgrading oil sand through various conventional methods.

Tar sands are grains of sand or porous rock deposited with bitumen, a very heavy, asphalt-like crude oil. The bitumen must be treated and upgraded before it can be fed to refineries for gasoline and fuel production. Tar sands contain varying fractions of bitumen (10-15% typically) and the remainder of sand, clay, and moisture. Bitumen deposited near the earth's surface can be recovered by open-pit mining techniques, while recovery methods for those deep in earth (>75 m) generally involve pumping and introduction of steam and solvents through vertical or horizontal wells. The mined surface tar sand can be mixed with steam and hot water, which allow the bitumen to float on the water while the sand sinks to the bottom of the container, thus achieving separation. Typical further processing involves heating the bitumen above 500° C. to convert about 70% of it to a synthetic crude oil. This oil can be distilled to yield kerosene and other liquid products. The remainder of the bitumen either thermally cracks to form gaseous products or reacts to form petroleum coke.

Petroleum asphaltenes are hydrocarbons having an extremely complex molecular structure with different proportions of nitrogen, sulfur, and oxygen. Asphaltenes can cause problems such as the blockage of crude oil extraction and transport pipes, and a reduction in their economic use. Asphaltene precipitation has also been a serious problem in oil recovery processes. The increasing production of heavy oils with a high content of asphaltenes makes their processing more difficult. Asphaltenes present in heavy oil and residuum strongly affect upgrading and refining operations. During the hydroprocessing of heavy feedstock, asphaltenes limit the efficiency of conversion and refining, acting as coke precursors that lead to catalyst deactivation.

The effect of asphaltenes and the solubility of asphaltenes in oil on the formation of solids have been extensively studied and reported in the last couple decades. Various approaches have been taken in the upgrading of asphaltenes. Catalytic (Mo) upgrading of Athabasca bitumen vacuum bottoms via a two-step hydrocracking and enhancement of Mo-heavy oil interaction has been recently reported. Solvent processing by dilution and centrifugal separation was explored to remove solids and part of the resin and asphaltene prior to hydrocracking. Further, reforming reactions of bitumen was carried out with kerosene as a solvent under nitrogen atmosphere. Toe-to-heel air injection was developed to enable high oil recovery and substantial in situ upgrading. The (HC)3TM hydrocracking technology was used to upgrade heavy crude oils and residues that was based on a hydrocracking process that used a two-phase, gas-liquid slurry reactor to convert up to 95% by weight of heavy oils and residues into distillates. Hydrotreatment of asphaltenes in the crude oil was shown to result in a complete conversion of the asphaltenes. Upgrading of heavy crude was carried out using either a hydrogen donor, formic acid as hydrogen precursor, or hydrogen donors and methane under steam injection conditions. Heavy oil upgrading process was carried out first by thermal cracking using visbreaking or hydrovisbreaking technologies to produce products with lower molecular weights and boiling points, followed by deasphalting and separation using an alkane solvent.

Other upgrade techniques for asphaltenes include: thermal cracking, thermal cracking in different solvents, solvent deasphalting followed by slurry hydroprocessing, through ultrasonic cavitation and surfactant use, superacid-catalyzed hydrocracking, superacid-catalyzed hydrocracking with supercritical water, hydrogenation with a NiMo-supported catalyst, ultrafiltration using ceramic membrane, using deasphalted oil, supercritical fluid extraction, thermal hydroprocessing, using a graded mesoporous catalyst system, sonochemical treatment, hot water treatment containing carbonate, hydropyrolysis, hydrocracking with an Mo-additive, hydrocracking with an Mo-additive, water, and transition metal catalysts, biocatalytic transformation through a modified cytochrome C, and flash-coking with the Lurgi-Ruhrgas process and hydrotreating.

The use of ozone in upgrading bitumen has sporadically appeared in the literature over the years. Ozone has been used in conversion of bitumen in tar sand into water-soluble derivatives. The process involved treatment of the tar sand with oxygen, air, or ozone and subsequently with an alkali sulfite solution. The resulting water-soluble sulfonated bituminous derivatives have emulsifying and dispersing power that may have potential for the in situ extraction of bitumen from tar sand. Ozone has been applied in the thermal dissolution of Kangalassy brown coal in tetralin, which resulted in increased solution due to change of oxygen-containing group properties of the product fluid. Tadzhikistan petroleum asphaltenes were ozonated producing C6-18 mono- and dicarboxylic acids as principal ether-soluble products, with small amounts of dicyclonaphthenes, keto-, hydroxyl-, and alkoxy acids, along with 0.03-0.4 wt. % S and N. Additionally, demulsifier products were obtained by ozonation in $CCl_4$/MeOH at a 1:(0.5-1) volume ratio followed by boiling with an alcohol solution of alkali.

Upgrading or extracting bitumen in supercritical fluids, e.g., water, ethane, $CO_2$, have been attempted. Upgrading of bitumen by hydrothermal visbreaking in supercritical water with alkali has produced paraffins and aromatics similar to pyrolysis, with similar time dependences of the visbreaking and desulfurization reactions but different effects of water. Upgrading of asphaltene by supercritical water with and without partial oxidation has been studied. The extraction of Peace River bitumen using supercritical ethane produced varying product properties with respect to conditions and time of extraction. Upgrading of bitumen using various n-alkanes as solvents in supercritical fluids has been performed. The process used activated carbon catalysts in a bench-scale plug-flow reactor, which produced favorable results when significant SCF, highly saturated or paraffinic supercritical solvent, hydrogen, and activated carbon catalyst were present. Other solvents, including pentane/benzene, $CO_2$, propane, pentane, were also used in supercritical conditions to extract bitumen from tar sand.

With the world-wide increase in the demand for oil and related products, devices and methods for improved recovery and upgrading of heavy hydrocarbons continue to be sought.

SUMMARY OF THE INVENTION

Accordingly, the present invention provides a method to recover valuable chemical products from tar sand by upgrading heavy hydrocarbons through contact with a fragmentation fluid. The fragmentation fluid can include ozone and a liquid solvent carrier. During contact with the fragmentation fluid, the heavy hydrocarbons are reduced in size, e.g., by physical separation into various components and/or breaking bonds of larger more complex molecules into smaller ones, to form a product mixture of chemical compounds. This product mixture is typically comprised of chemical species which are more suitable than the original heavy hydrocarbons to commercial uses and/or further separation to provide useful starting materials for a wide variety of synthesis and industrial applications.

In one detailed aspect of the present invention, the fragmentation fluid is provided at supercritical conditions. For example, the liquid solvent carrier can be a supercritical fluid, such as supercritical $CO_2$. In yet another aspect of the present invention, the product mixture can be separated from the fragmentation fluid.

A wide variety of heavy hydrocarbons can be treated in accordance with the principles of the present invention, including but not limited to asphaltenes, paraffin waxes, tar, tar sands, coke, atmospheric tower refining bottoms, refining residuums, fuel oil, vacuum tower bottoms, residual fuel oils, and combinations or mixtures thereof. In one specific aspect, the methods of the present invention can be particularly suited to upgrading of asphaltenes or petroleum waste products.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION

Figure 1:
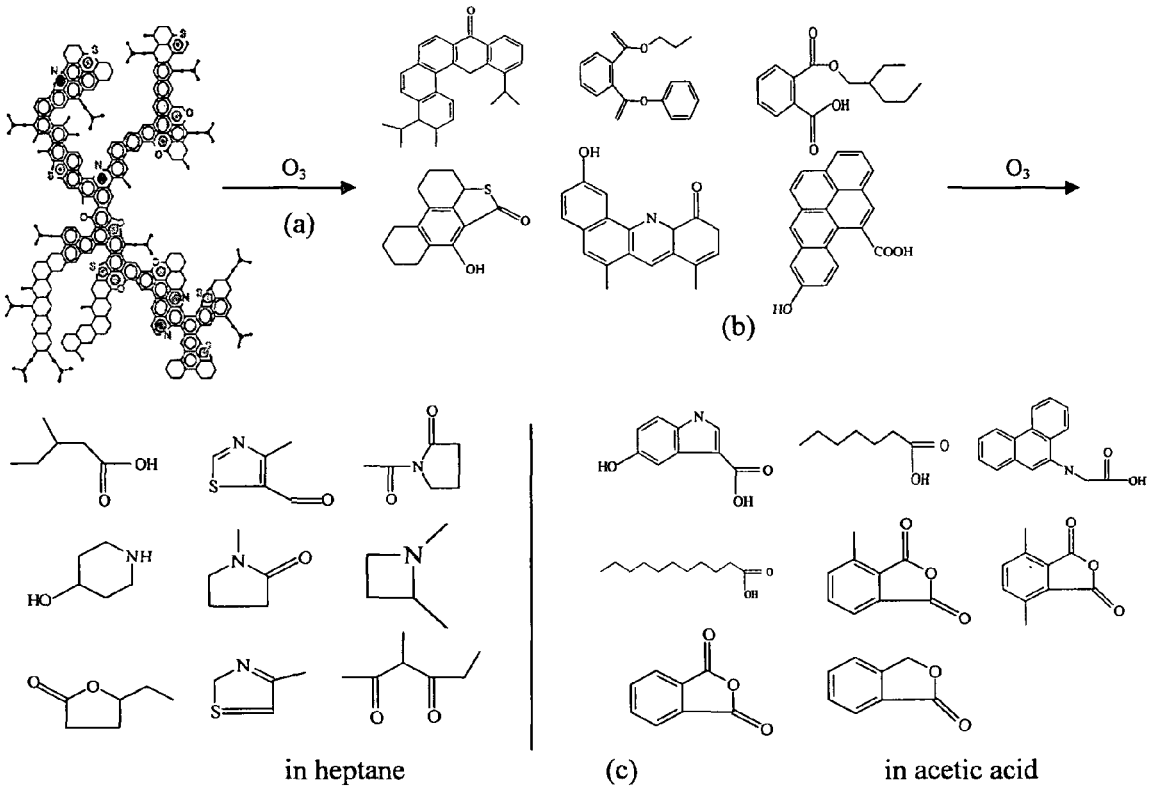
FIG. 1 is a proposed structure for asphaltenes and a reaction sequence and associated products identified from practice of an embodiment of the present invention.

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "a fragmentation fluid" includes one or more of such components, reference to "a secondary solvent" includes reference to one or more of such materials, and reference to "a separation process" includes reference to one or more of such processes.

Definitions

In describing and claiming the present invention, the following terminology will be used in accordance with the definitions set forth below.

As used herein, "heavy hydrocarbons" refers to hydrocarbons which are solid or extremely viscous at standard processing conditions. Thus, heavy hydrocarbons are typically difficult to handle and tend to present problems with fouling, clogging, caking, and other undesirable conditions. Heavy hydrocarbons include materials such as, but not limited to, asphaltenes, tars, paraffin waxes, coke, refining residuums, and other similar residual hydrocarbon materials. Typically, heavy hydrocarbons are not amenable to separation treatments such as distillation and the like and are most often either solid or highly viscous. Further, heavy hydrocarbons tend to have molecular weights of up to 2,000,000. While heavy hydrocarbons typically have molecular weights from about 700 to 2,000,000; heavy hydrocarbons may contain compounds with molecular weights less than 700. For the purposes of the present invention, heavy hydrocarbons include any material that comprises a majority of hydrocarbon materials with a molecular weight range of about 700 to 2,000,000.

As used herein, "asphaltenes" refers to heavy hydrocarbons composed of complex aromatic and polynuclear hydrocarbons. Asphaltenes are typically recovered from bitumen of petroleum, petroleum products, malthas, asphalt cements, solid native bitumens, and the like. Further, asphaltenes tend to have molecular weights of up to about 20,000, and most often greater than about 700, wherein complex polycyclic aromatic hydrocarbon structures are linked by alkyl chains.

As used herein, "paraffin waxes" refers to heavy hydrocarbons which are primarily composed of high molecular weight alkanes having twenty or more carbons and can include amorphous and/or crystalline forms.

As used herein, "tars" refers to heavy hydrocarbons composed of complex mixtures of aromatic hydrocarbons, oils, pitch, creosotes, and/or the like. As a general matter, tars have an overall average molecular weight between that of heavier asphaltenes and paraffin waxes. However, tars often contain mixtures of light oils such as benzene and its derivatives, heavier oils, pitch, and other materials.

As used herein, "supercritical fluid" refers to any material which is at supercritical conditions for the particular fluid. These conditions of pressure and temperature are well known and can be identified for a particular fluid by those skilled in the art. For example, supercritical $CO_2$ has a $P_c$ of 73.8 bar and a $T_c$ of 31.1° C. Thus, a supercritical fluid is a fluid which is placed within the critical conditions of pressure and temperature for the material. Supercritical conditions tend to cause the properties of supercritical fluids to behave differently than would be expected for the same materials in the liquid or gaseous states.

As used herein, "catalyst" refers to any material that increases the rate of a reaction without being consumed; after the reaction it can potentially be recovered from the reaction mixture chemically unchanged. The catalyst lowers the activation energy required, allowing the reaction to proceed more quickly or at a lower temperature. In the present invention, a catalyst would increase the rate of the oxidation of the heavy hydrocarbons.

As used herein with respect to an identified property or circumstance, "substantially" refers to a degree of deviation that is sufficiently small so as to not measurably detract from the identified property or circumstance. The exact degree of deviation allowable may in some cases depend on the specific context. Similarly, "substantial" when used in reference to a quantity or amount of a material, or a specific characteristic thereof, refers to an amount that is sufficient to provide an effect that the material or characteristic was intended to provide. Further, "substantially free" when used in reference to a quantity or amount of a material, or a specific characteristic thereof, refers to the absence of the material or characteristic, or to the presence of the material or characteristic in an amount that is insufficient to impart a measurable effect, normally imparted by such material or characteristic.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Invention

Accordingly, the present invention provides a method to recover valuable chemical products from materials containing heavy hydrocarbons such as tar sand and other materials. In one aspect of the present invention, a method of upgrading heavy hydrocarbons can include contacting the heavy hydrocarbons with a fragmentation fluid. The fragmentation fluid can include ozone and a solvent carrier. During contact with the fragmentation fluid, the heavy hydrocarbons are reduced in size, e.g., by physical separation into various components and/or breaking bonds of larger more complex molecules into smaller ones, to form a product mixture of chemical compounds. This product mixture is typically comprised of chemical species, including alcohols, aldehydes, and organic acids, which are more suitable than the original heavy hydrocarbons to commercial uses and/or further separation to provide useful starting materials for a wide variety of synthesis and industrial applications.

In one detailed aspect of the present invention, the fragmentation fluid can be provided at supercritical conditions. For example, the solvent carrier can be a supercritical fluid. Although other supercritical fluids may be suitable, non-limiting examples of suitable supercritical fluids for use as the solvent carrier include supercritical $CO_2$, supercritical $N_2O$, supercritical $NH_3$, supercritical ethane, supercritical lower alkanes, and combinations or mixtures thereof. As a general guideline, the ratio of the supercritical fluid to ozone can be any amount sufficient to achieve upgrading of the heavy hydrocarbons to commercially useful compounds. Typically, the supercritical fluid can comprise from about 50 vol % to about 99.9 vol %, and in some cases from about 85 vol % to about 99.0 vol %. Currently, the preferred solvent carrier is supercritical $CO_2$. One advantage of supercritical $CO_2$ is the availability, low toxicity, and ease of disposing of $CO_2$. Additionally, supercritical $CO_2$ has a relatively low critical temperature and pressure which helps to reduce costs of processing. Thus, in some aspects of the present invention, the supercritical fragmentation fluid can be substantially free of organic solvents other than $CO_2$. Further, in one aspect, the fragmentation fluid can consist essentially of supercritical $CO_2$ and ozone.

In one alternative aspect of the present invention, the solvent carrier can be a liquid solvent such as methanol, ethylene, heptane, dichloromethane, tetrachloromethane, acetic acid, 2-propanol, acetonitrile, and combinations thereof. Currently preferred liquid solvent carriers can include methanol, ethylene, heptane, dichloromethane, acetic acid, and combinations and mixtures thereof. The solvent carrier to oxidizing agent ratio can very depending on the starting materials and the desired extent of reaction. However, typically the liquid solvent carrier can comprise from about 20 vol % to about 99.9 vol %, and in some cases from about 50 vol % to about 99.5 vol %. In another aspect of the present invention, the liquid solvent carrier can be an alcohol. The addition of an alcohol to the fragmentation fluid can produce commercially valuable products in the form of biodiesel compounds through the esterification of the organic acid fragmented components.

Any suitable ozone source can be used to provide the oxidizing agent. The specific content of ozone in the fragmentation fluid will most often depend, in large part, on the type of heavy hydrocarbons and the desired extent of reaction. However, as a general guideline ozone can comprise from about 0.1 vol % to about 80 vol %, and preferably from about 0.5 vol % to about 10 vol %.

In yet another alternative aspect, the supercritical fragmentation fluid can further include a secondary solvent. The secondary solvent can be added in small amounts in order to modify the properties of the solvent carrier. The secondary solvent can be used to modify the solvent polarity, acidity, or the like of the fragmentation fluid. The secondary solvent can be chosen and added in various proportions in order to improve upgrading of specific types of heavy hydrocarbons and/or improve the ability to extract or separate products from the solvent carrier. Non-limiting examples of suitable secondary solvents can include methanol, ethylene, hydrochloric acid, ammonia, 2-propanol, acetonitrile, dichloromethane, water, and combinations or mixtures thereof. For example, hydrochloric acid can increase acidity, while ammonia can increase basicity. The secondary solvent is typically introduced into the carrier solvent in relatively small amounts. For example, the secondary solvent can range from about 0.1% by volume to about 5% by volume, although amounts of about 1% by volume are most typical.

Additionally, or in the alternative, the solvent carrier and/or any secondary solvents can be recovered and reused in order to reduce costs and disposal concerns. Subsequent to fragmentation of the heavy hydrocarbons the product fragments can be extracted in the solvent carrier. Separation of the product fragments from the solvent carrier can be readily achieved when the solvent carrier is supercritical $CO_2$ or other materials which are gaseous at ambient pressures. Alternatively, separation of the extracted products from the solvent carrier can be accomplished through taking advantage of various properties including density differences, liquid-liquid phase separations, secondary extraction processes (e.g. liquid-liquid extraction or liquid-gas extraction), or the like.

A wide variety of heavy hydrocarbons can be treated in accordance with the principles of the present invention. One particularly advantageous class of chemical compounds include those which are considered waste products or are residual from other processes. Non-limiting examples of suitable heavy hydrocarbons can include asphaltenes, paraffin waxes, tar, coke, atmospheric tower refining bottoms, refining residuums, fuel oil, vacuum tower bottoms, residual fuel oils, and combinations or mixtures thereof. The present method contemplates upgrading heavy hydrocarbons with a molecular weight range of about 700 to 2,000,000; often from about 750 to about 100,000; and in certain cases from about 750 to about 20,000. Upgrading heavy hydrocarbons in accordance with the present invention generally produces hydrocarbon products with a molecular weight of less than about 400, and preferably less than about 280 that can be further refined and retain commercial value. More specifically, degradation of a majority of the heavy hydrocarbons to more fundamental molecules such as water, hydrogen, carbon dioxide, methane, etc. reduces the commercial value of the products. Thus, it is typically desirable to control the extent of reaction to obtain products having a majority of the compounds having a molecular weight within the range of about 45 to about 400, and preferably from about 50 to about 280.

In one specific aspect, the methods of the present invention can be particularly suited to upgrading of asphaltenes. Asphaltene is a very high molecular-weight, solid, organic macromolecule. Very limited knowledge is garnered on the molecular structure of this material despite decades of intense studies and analyses. Asphaltenes are substantially made of C, H, N, O, and S elements, and can range in molecular weight from 1,000 to over 2,000,000, but are typically up to about 1,000,000. Complex asphaltene molecules contain both aromatic and aliphatic portions with fused aromatic rings having electron-rich aromatic bonds. These fused aromatic rings are links that hold the giant molecule together. As an example, see the first structure shown in FIG. 1. By breaking the aromatic rings, the macromolecule can be fragmented into smaller molecules which are more easily utilized. These smaller molecular fragments can have much lower molecular weights and are amenable to dispersion in solvents for subsequent transport and processing.

FIG. 1 illustrates one potential reaction pathway for fragmentation of an asphaltene molecule by ozonation into smaller molecules of alcohols, aldehydes, and acids which have already been identified using GC/MS (gas chromatograph/mass spectrometry). A variety of other known analytical techniques can also be used to identify product fragments such as, but not limited to, GC/FID, HTGC, GC/MS, and the like. FIG. 1, part (a) reflects the initial fragmentation of an asphaltene into reaction intermediates as shown in part (b) that are further oxidized by ozone to produce two sets of hydrocarbon products shown in part (c). The first set of products was obtained using n-heptane as the solvent carrier, while the second set was obtained using acetic acid as the solvent. The resulting product fragments can be fed to refineries and processed to produce fuel and in the synthesis of other chemicals.

The choice of solvent carriers can affect the fragmentation reaction such that different product fragments are produced as shown in FIG. 1, part (c). Similarly, the solvent carrier can affect reaction yields and overall efficiencies. Non-limiting examples of potentially suitable solvents include hexane, heptane, tetrachloromethane, trichloromethane, dichloromethane, chloromethane, acetic acid, any combination thereof, and other similar polar solvents. The particular solvent and associated polarity can affect the preferential formation and types of products. These products can be continually withdrawn from the reaction medium. Solvent carriers can be chosen having a variety of properties. For example, solvents which are polar, non-polar, or mixtures of both types of solvents can be used to achieve a desired effect on product yields, fragmentation products, and process efficiency. In some embodiments, a miscible solvent consisting of both a polar and a nonpolar solvent (e.g., 1:1 acetic acid and heptane) can be used. When acceptable, environmentally benign solvents can be preferably used. Although not strictly required, preferable organic solvents should be environmentally benign and oxidation (e.g. $O_3$) resistant.

Additionally, the methods of the present invention can be applied directly to bitumen and other raw materials within or recovered from tar sands, oil shale, heavy crudes, or the like. In one aspect, the heavy hydrocarbons can be tar sand bitumen. Thus, the methods of the present invention can be applied to raw materials such that recovery of hydrocarbons from shale, sands, etc. and upgrading to more useful hydrocarbons species can be affected in a single step.

Figure 2:
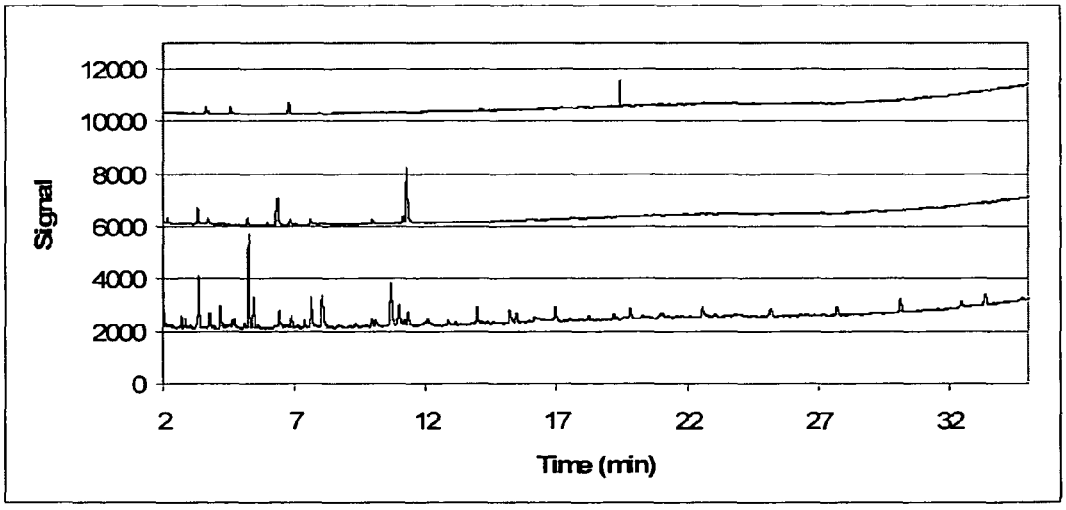
FIG. 2 is a GC/FID chromatogram of several product mixtures in accordance with an embodiment of the present invention.

Specifically, FIG. 2 illustrates the effectiveness of upgrading tar sand through the method of the present invention. The three baselines correspond to GC/FID chromatograms of DCM extracts of tar sand before ozonation (upper), after 10 min of ozonation (lower), and after 10 min of ozonation of the solvent only (middle). A comparison of the chromatographs shows a considerable increase in fragmentation products after ozonation. Additionally, the lower chromatograph showed that fragmentation products are a function of reaction time.

In yet another aspect of the present invention, the product mixture can be separated from the fragmentation fluid. This separation can be achieved using separations processes such as extraction, distillation, condensation, stripping, or the like. In one specific aspect, the product mixture can be separated by condensation of the products, and directing the remaining carbon dioxide, ozone, oxygen, and/or other gaseous byproducts to an exhaust or appropriate scrubbing or gas treatment system. In many cases, continual removal of the products can be desirable in order to prevent fragmenting the useful products into much smaller and less useful products, e.g. carbon dioxide, hydrogen, methane, etc.

The heavy hydrocarbon can be contacted with the fragmentation fluid for a time which is sufficient to achieve a desired degree of fragmentation and upgrading. The time necessary can depend on the specific components of the reaction, as well as the concentration of each species, temperature, and pressure. Typically, it can be desirable to contact the heavy hydrocarbons for a time sufficient to upgrade over about 20% by weight of the heavy hydrocarbons into fragmentation products, and preferably greater than about 80% by weight. As a general guideline only, the step of contacting can occur over a time from about 30 seconds to 60 minutes and preferably 60 seconds to 30 minutes. In another detailed aspect of the present invention, the step of contacting can occur at least partially at supercritical conditions of the fragmentation fluid.

A variety of reactor configurations can be used in connection with the present invention. Each configuration can impact the product yield and efficiencies. Both batch and flow reactors can be used depending on the particular carrier solvent, oxidizing agent, and optional organic solvents used, as well as the designed concentrations of each. As the goal is to produce smaller chemical molecules from the heavy hydrocarbons such as asphaltene and not to completely mineralize them, desirable products should be continually withdrawn from the reactive zone that is rich in ozone. Flow reactors can be used to continually supply heavy hydrocarbon materials and withdraw desirable products as well as to facilitate solvent recovery and reuse. Alternatively, a batch reactor can be used to treat the heavy hydrocarbon material such as tar sand, while also using a continuous flow of fragmentation fluid. In yet another alternative, the reactor configuration can include contacting the heavy hydrocarbon material and fragmentation fluid in a counter-flow system. This type of system can also be used to control the extent of fragmentation with less emphasis on removal of the product mixture.

Specific operating conditions, yields, and efficiencies can vary depending on the particular feedstock, and other variables. However, as a general guideline, the heavy hydrocarbons can be reduced to product fragments at yields from about 50% to about 90%, and preferably from about 75% to about 90%.

EXAMPLES

The following examples illustrate exemplary embodiments of the invention. However, it is to be understood that the following are only exemplary or illustrative of the application of the principles of the present invention. Numerous modifications and alternative compositions, methods, and systems may be devised by those skilled in the art without departing from the spirit and scope of the present invention. The appended claims are intended to cover such modifications and arrangements. Thus, while the present invention has been described above with particularity, the following examples provide further detail in connection with what is presently deemed to be practical embodiments of the invention.

Example 1

An asphaltene-containing petroleum waste product containing up to about 40% asphaltene by weight was mixed with heptane to form a slurry. The heptane slurry was stirred and ozonated for 10-60 min. After the tar sand was separated by filtration and the filtrate evaporated, a light-color oil was produced (products identified in FIG. 1C).

Similarly, an amount of 5 grams of asphaltene petroleum waste was placed in 100 mL of heptane to form a slurry. Under continuous mixing conditions, ozone (about 1-2% ozone by weight) was passed through the slurry at a rate of about 0.8 L/min. A light oil was recovered at a weight of about 0.31 g. The yields and ozonation duration have not been optimized; however, the above results indicate recovery of useful light oils can be achieved using this process.

Additional control experiments without either ozone or tar sand yielded no light oil, but a small amount of dark residue (0.1 g) extracted from the solid. The combined mass of the residual sand and light oil product increased by 0.52 g due to oxygenation of the chemical compounds. In contrast, the combined mass (residual solid+extracted dark residue) resulted in no significant weight change when the solid was subject to aeration under otherwise identical conditions. It is expected that tar sand and asphaltenes waste products containing up to 15% asphaltene will behave similar to the above 40% sample.

Example 2

The same asphaltene-containing waste as above was ozonated as described in Example 1 using acetic acid as a treatment medium. The described procedures yielded a variety of additional compounds (products also identified in FIG. 1C) with comparable weight changes after ozonation, and again no significant changes after aeration.

Example 3

Asphaltene-containing waste (as in Example 1) in an amount of 3 grams was soxhlet-extracted with 250 mL of dichloromethane (DCM), resulting in a dark crude oil-like solution. GC/FID results of the dark solution showed primarily an unresolved complex mixture (UCM) prior to ozonation as shown in FIG. 2 (upper line). The UCM was subjected to ozonation for about 10 min and GC/FID analysis revealed an abundance of new compounds with small retention times (<30 min) as shown in FIG. 2 (lower line). The center line of FIG. 2 shows the DCM solvent without the asphaltenes after ozonation for 10 minutes as a comparison. The results show that the heavy asphaltenes were fragmented into smaller compounds.

Example 4

A solution of 20 mL of tetrachloromethane and 2 grams of an asphaltenes-containing waste was extracted from a tar sand mixture. The solution was a dark $CCl_4$ extract containing asphaltenes. The solution was then ozonated for 10 min. A compact, colloidal suspension readily occurred and floated on top of the now clear $CCl_4$ solvent. This provided a convenient method for extraction of asphaltene from tar sand, followed by recovery of the solvent which could be easily used in further processing of the extracted asphaltene.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method of upgrading heavy hydrocarbons, comprising the step of contacting the heavy hydrocarbons with a fragmentation fluid to form a product mixture of smaller molecular fragments, said fragmentation fluid including ozone and a liquid solvent carrier, wherein the liquid solvent carrier is a supercritical fluid and the heavy hydrocarbons have a molecular weight from about 700 to 2,000,000.

2. The method of claim 1, wherein the liquid solvent carrier comprises a member selected from the group consisting of supercritical $CO_2$, supercritical $N_2O$, supercritical $NH_3$, supercritical ethane, supercritical lower alkanes, and combinations or mixtures thereof

3. The method of claim 2, wherein the liquid solvent carrier is supercritical $CO_2$.

4. The method of claim 1, wherein the liquid solvent carrier comprises from about 50 vol % to about 99.9 vol % of the fragmentation fluid.

5. The method of claim 1, wherein the fragmentation fluid further comprises a secondary liquid solvent.

6. The method of claim 5, wherein the secondary liquid solvent is a member selected from the group consisting of methanol, ethylene, hydrochloric acid, ammonia, 2-propanol, acetonitrile, dichloromethane, water, and combinations or mixtures thereof.

7. The method of claim 1, wherein the step of contacting is substantially free of a catalyst that participates in upgrading of the heavy hydrocarbons.

8. The method of claim 1, wherein the heavy hydrocarbons are a member selected from the group consisting of asphaltenes, paraffin waxes, tar, tar sands, petroleum waste products, and combinations thereof.

9. The method of claim 8, wherein the heavy hydrocarbons are asphaltenes.

10. The method of claim 8, wherein the heavy hydrocarbons are petroleum waste products.

11. The method of claim 8, wherein the heavy hydrocarbons are tar sands.

12. The method of claim 1, wherein the heavy hydrocarbons have a molecular weight from about 750 to 20,000.

13. The method of claim 1, wherein the step of contacting occurs over a time from about 30 seconds to 60 minutes.

14. The method of claim 1, further comprising the step of separating the product mixture from the fragmentation fluid.

15. The method of claim 14, further, comprising the step of separating the product mixture into useful fractions for further processing.

16. The method of claim 1, wherein a majority of the product mixture has a molecular weight from about 45 to about 400.

* * * * *